United States Patent [19]

Kihara et al.

[11] Patent Number: 4,845,895

[45] Date of Patent: Jul. 11, 1989

[54] INTERNAL GRINDING MACHINE

[75] Inventors: Hiroyuki Kihara; Isaoi Ogawa, both of Narashino, Japan

[73] Assignee: Seiko Seiki Kabushiki Kaisha, Japan

[21] Appl. No.: 5,095

[22] Filed: Jan. 20, 1987

[30] Foreign Application Priority Data

Jan. 20, 1986 [JP] Japan ..... 61-9769

[51] Int. Cl.[4] ..... B24B 5/10

[52] U.S. Cl. ..... 51/33 W; 51/290; 51/50 H

[58] Field of Search ..... 51/33 W, 290, 33 R, 51/166 TS, 166 FB, 166 MH, 50 R, 50 H

[56] References Cited

U.S. PATENT DOCUMENTS 2,647,348 8/1953 Hahn ..... 51/290

3,541,870 11/1970 Lyons ..... 51/33 W 4,606,150 8/1986 Grimm ..... 51/290

*Primary Examiner*—Frederick R. Schmidt

*Assistant Examiner*—Robert A. Rose

*Attorney, Agent, or Firm*—Bruce L. Adams; Van C. Wilks

[57] ABSTRACT

An internal grinding machine for grinding the inner surface of a work comprises a traverser table (11) mounted on a bed (10) for sliding movement in the longitudinal direction of the bed, a grinding head (15) mounted on the table for free position adjustment in the longitudinal direction, and a grinder shaft spindle (16) fixed to the upper surface of the grinding head (15) and provided on the front end surface thereof with a grinder shaft which carries at its end a grinder (19), the traverser table being adapted to slide so as to bring the grinder to a predetermined position with respect to the work, wherein the grinding head being arranged such that its rear end can swing to the left and right about the center (17) of the front end thereof, the rear end of the grinding head being connected to an eccentric cam mechanism (21) which in turn is connected to a driving portion (22), so that the grinding head is swung by a predetermined angle in accordance with the amount of eccentricity of the eccentric cam mechanism obtained in accordance with the operation of the driving portion.

Accordingly, the internal grinding machine of this invention is capable of effecting grinding of the inner surface with high degree of precision (cylindricity and straightness), in the manner where a quill is made to be positioned at a specified angle in the region where the quill tends to flex during its traversing movement.

9 Claims, 3 Drawing Sheets

INTERNAL GRINDING MACHINE

BACKGROUND OF THE INVENTION (1) [Field of the Invention]

The present invention relates to an internal grinding machine for grinding the inner surface of a work piece or work and, more particularly, to an internal grinding machine which is suitable for use in the grinding of a work which has to be finished with a specific high degree of precision and especially as regards a work which is desired to be finished to a particular level of cylindricality and straightness.

(2) [Description of the Prior Art]

In general, grinding a long bore such as that in a plunger barrel 1 (see FIG. 5) requires a long grinder shaft (referred to sometimes as a "quill" hereinafter); see, for example, member 18 in FIG. 1 having a relatively small diameter. More specifically, a high grinding effect is produced by a combination of an elongated quill 2 and a narrow grinder 3 (see FIG. 5). The grinding of the cylindrical bore takes a long time, with the grinder 3 projecting out of the work 1 by a sufficient amount as shown in FIG. 5.

The grinding of the work 1 having a long in the prior art bore, however, encounters a problem in that the inner peripheral surface of the work 1, particularly the inner surface of the distal end portion of the work 1 (see FIG. 6—Prior Art), is ground in a tapered form due to flexing of the quill and the grinder. This makes it difficult to obtain the desired level of cylindricality.

Under this circumstance, the present inventors have found that the grinding can be conducted with sufficiently high cylindricality, provided the path of traversing movement of the grinder 3 is so controlled and determined that the quill-grinder system is inclined in the region where the prior art quill-grinder system tends to flex.

SUMMARY OF THE INVENTION

Accordingly, an object of the present invention is to provide an internal grinding machine for grinding the inner surface of a work, wherein a quill is made to incline during its traversing movement in the region where the quill tends to flex in the prior art, thereby effecting grinding of the inner surface of the work with a high degree of precision as regards cylindricality and straightness.

To this end, according to the present invention, there is provided an internal grinding machine comprising a traverser or traverser table mounted on a bed for sliding movement in the longitudinal direction of the bed, a grinding head mounted on the traverser table for free position adjustment in the longitudinal direction, and a grinder shaft spindle fixed to the upper surface of the grinder head and provided on the front end surface thereof with a grinder shaft or quill which carries at its distal end a grinder, the traverser table being adapted to slide so as to bring the grinder to a predetermined position with respect to the work thereby enabling the grinder to grind the inner surface of the work. The grinding head is arranged such that its rear end can swing to the left and right about the center of the front end thereof, the rear end of the grinding head being connected to an eccentric cam mechanism which in turn is connected to a driving portion of the invention, so that the grinding head is swung through a predetermined angle in accordance with the amount of eccentricity of the eccentric cam mechanism obtained in accordance with the operation of the driving portion of the invention.

DETAILED DESCRIPTION OF THE INVENTION

An embodiment of the internal grinding machine in accordance with the present invention will be described hereinafter with reference to the accompanying drawings.

Figure 1:
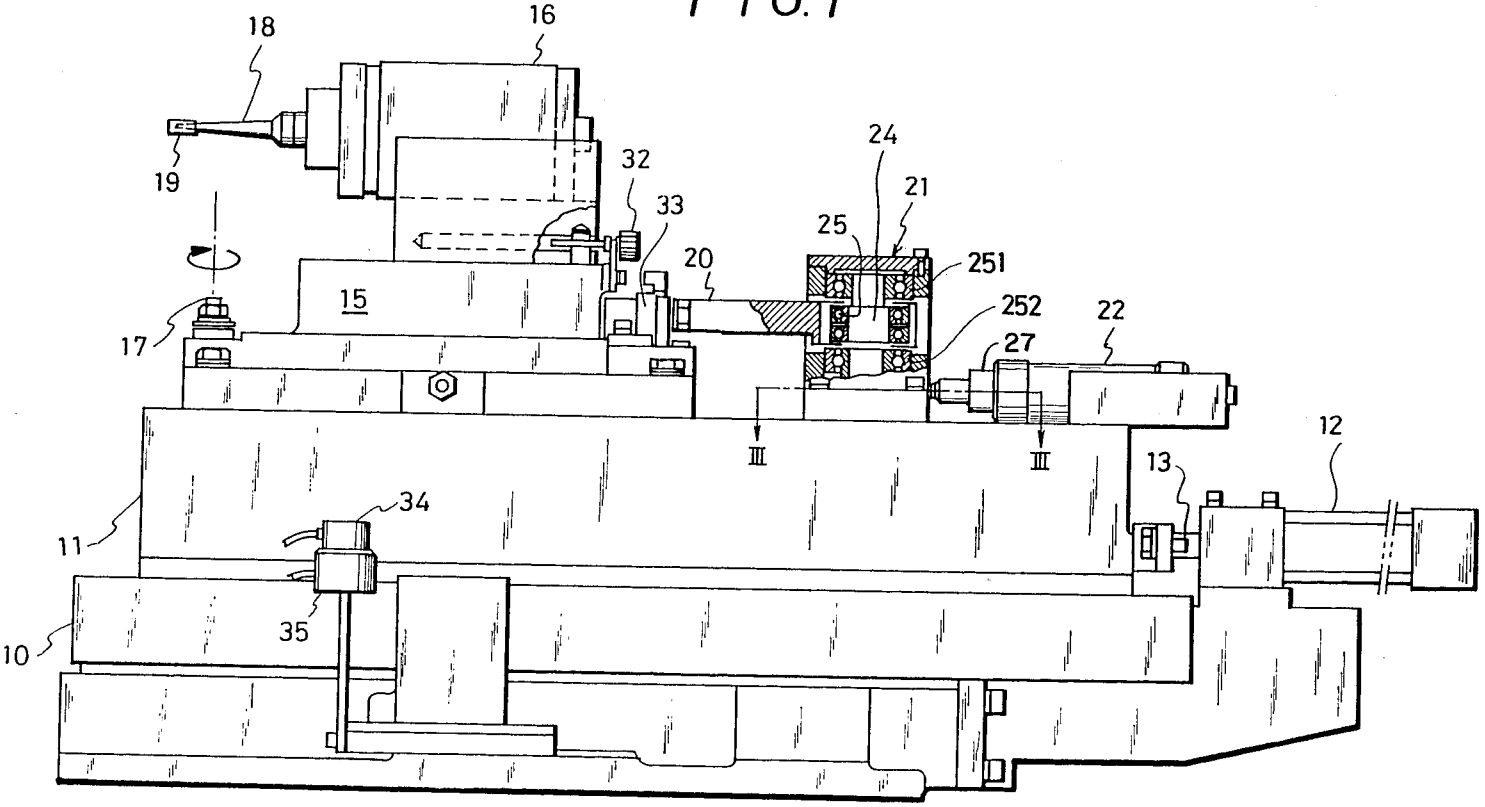
FIG. 1 is a partly-sectioned side elevational view showing the whole of an internal grinding machine in accordance with the present invention.

A description will be conducted hereinafter as to the general construction of the whole of the internal grinding machine in accordance with the present invention, beginning with specific reference to FIG. 1.

The internal grinding machine of the present invention has a bed which is generally designated at reference numeral 10. A traverser or traverser table 11 is mounted on the upper surface of the bed 10 for traversing sliding movement in the longitudinal direction of the bed 10. A hydraulic cylinder 12 fixed to the bed 10 has a cylinder rod 13 which is connected to the rear end of the table 11. The arrangement is such that as the table's cylinder rod 13 moves back and forth, the table 11 slides on the bed 10 over a predetermined stroke.

The table 11 carries at its upper surface a grinding head 15 which in turn carries at its upper surface a grinder shaft spindle 16. The grinding head 15 is mounted in such a manner that the front end thereof is swung to the left and right above a pivot point 17 which is substantially at the center of the front end of the grinding head. A quill or grinder shaft 18 is formed integrally with the sprindle 16 such as to project from the front end surface of the grinder shaft spindle 16 towards the work. A grinder 19 is positioned on the end of the quill 18. The grinder shaft spindle 16 is mounted and secured to the upper surface of the grinding head 15 for free position adjustment in the longitudinal direction.

The rear end of the grinding head 15 is connected to the eccentric cam mechanism 21 through a connecting plate 20. The eccentric cam mechanism 21 is actuated by a hydraulic cylinder 22.

Figure 2:
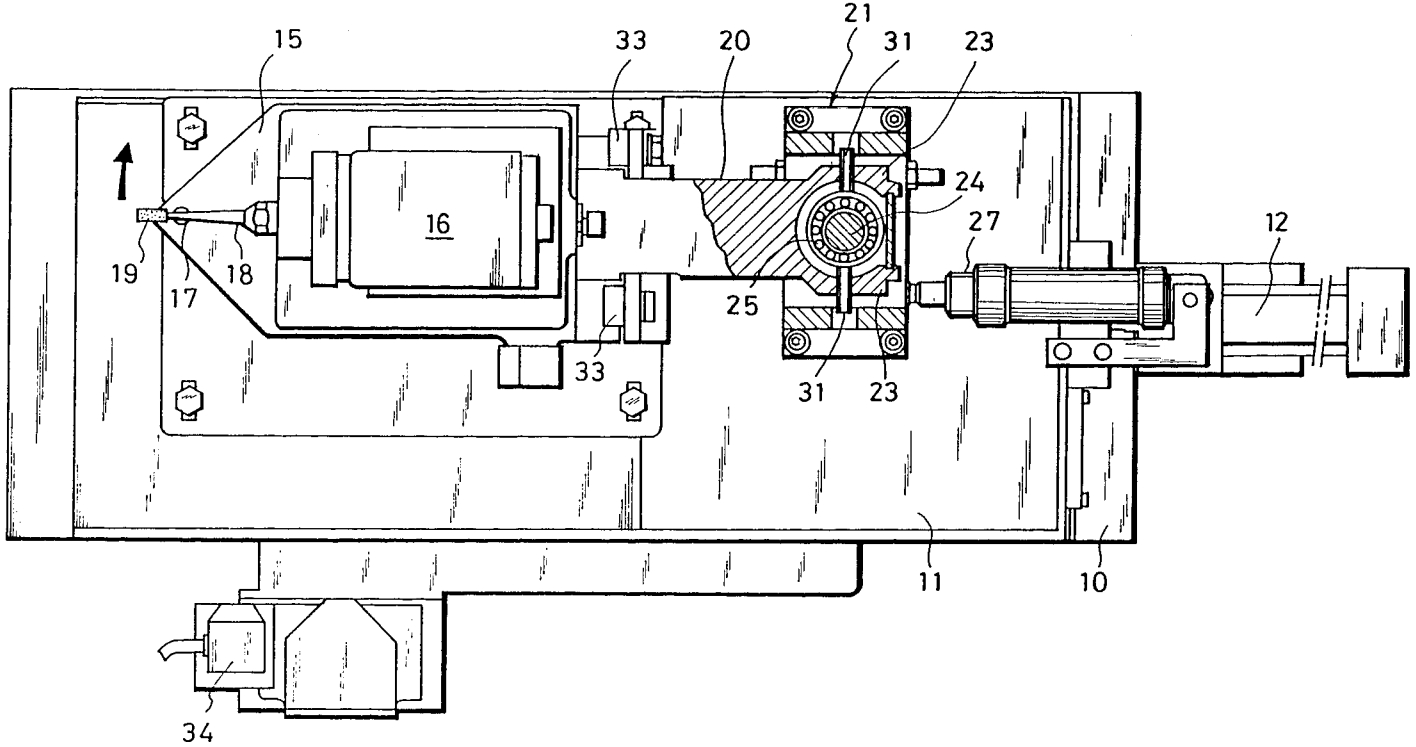
FIG. 2 is a partly-sectioned plan view of the whole portion of the internal grinding machine.

The construction of the eccentric cam mechanism 21 will be explained hereinafter. As shown in FIG. 1 and FIG. 2, the rear end of the connecting plate 20 is bifurcated to provide a pair of arms 23 and 23 which slidably contact the outer peripheral surface of an eccentric cam shaft 24 through eccentric cam shaft bearing 25. The arrangement is such that the eccentric cam shaft 24 is rotated by a predetermined angle through the operation of a rotary plate 28 (see FIG. 3) by the operation of the cam mechanism's cylinder rod 27 which is actuated by the cam's mechanism hydraulic cylinder 22.

Figure 3:
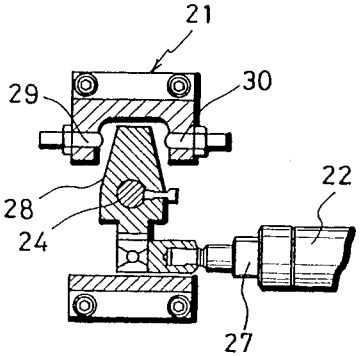
FIG. 3 is a sectional view taken along the line III—III of FIG. 1.

More specifically, as will be seen from FIG. 3, the cam mechanism's cylinder rod 27 is moved back and forth by the force produced by the cam mechanism's hydraulic cylinder 22, so that the cam mechanism's rotary plate 28 is rotated in the direction of the arrows. The rotation of the cam mechanism's rotary plate 28 in turn causes the eccentric cam shaft 24 to be rotated through a predetermined angle, and the leftward and rightward displacement of the eccentric cam shaft 24 is transmitted to the arm portions 23 connecting place 20 through the eccentric cam shaft bearing 25. In consequence, the grinding head 15 is rotated such that its rear end is swung about the pivot point 17, responsive to movement of the connecting plate 20.

In FIG. 3, reference numerals 29 and 30 denote, respectively, a rear stroke end stopper and a front stroke end stopper. The rotation of the grinding head 15 about pivot point 17 is limited as the free end of the rotary plate 28 is stopped by these stoppers 29 and 30. Referring now to FIG. 2, clearance adjusting screws 31 are screwed into both side surfaces of the arm portions 23 of the connecting plate 20, so as to face to the upper and lower bearings (251, 252 in FIG. 1) of the eccentric cam mechanism 21 respectively. The arrangement is such that the initial angle of inclination of the grinder shaft spindle 16 is adjusted by operating the clearance adjusting screws 31.

A description will be given hereinafter as to the operation of the internal grinding machine in accordance with the present invention.

First of all, the grinder shaft spindle 16 is fixed at a predetermined position on the upper surface of the grinding head 15. The spindle 16 can be located precisely by a series of process steps which include loosening of adjusting screw 32 for the grinder shaft spindle 16, adjusting the position of the grinder shaft spindle 16, and then tightening the adjusting screw 32. This means that the horizontal distance between the pivot point 17 for rotation of the grinding head 15 and the grinder 19 can be set as desired. For instance, when a comparatively large inclination is required, the grinder shaft spindle 16 is fixed to the front end of the grinder 15.

Figure 5:
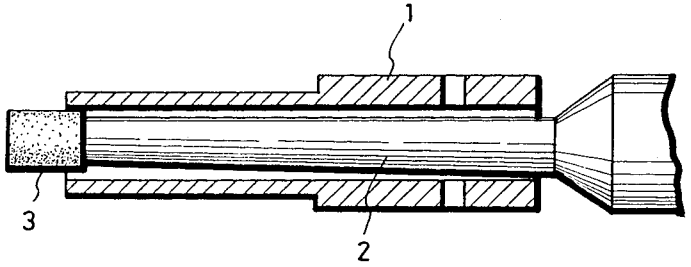
FIG. 5 is an illustration of the relationship between the work and the grinder in accordance with the present invention.
Figure 6:
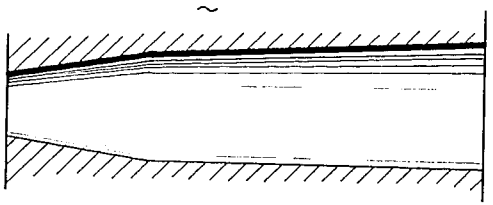
FIG. 6 PRIOR ART
FIG. 6 is an illustration of the manner in which a work is ground by a conventional prior art internal grinding machine lacking the features of the present invention.

Subsequently, the traverser table's hydraulic cylinder 12 operates to bring the table 11 from a work stand-by or non-working position to a work machining position. Then, the grinder 19 is disposed on the inner surface of the work (such as in FIG. 5) and the quill 18 is rotated through the grinder shaft spindle 16, thereby effecting traversing grinding.

In the internal grinding machine in accordance with the present invention, when a long bore such as that in a plunger barrel is to be machined, the cam mechanism's hydraulic cylinder 22 operates during the traversing grinding so as to extend the cam mechanism's cylinder rod 27 forward by a predetermined stroke, thereby causing the eccentric cam 24 to rotate through a predetermined angle.

Figure 4:
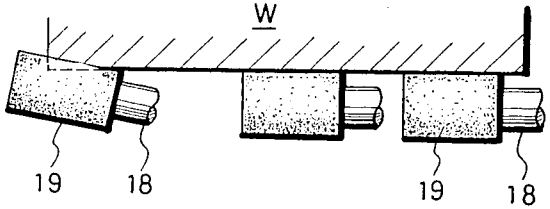
FIG. 4 is an illustration of the path of traverse of the internal grinding machine of the present invention.

The displacement of the eccentric cam shaft 24 in the longitudinal direction is absorbed by the clearance left between the bifurcated connecting plate 20 and the eccentric cam shaft 24. However, the displacement of the eccentric cam shaft 24 in the left and right directions is transmitted to the arm portions 23 of the connecting plate 20 through the bearing 25, so that the connecting plate 20 and the grinding head 15 as a unit is slightly offset in the direction of an arrow (seen to the left in FIG. 2) about the pivot point 17. Consequently, the quill 18 carrying the grinder 19 is inclined so that traversing is effected in the direction which is not parallel to the inner surface of the work but is slightly inclined to the inner surface of the work. More specifically, according to the invention, the path of traverse of the grinder 19 in the internal grinding machine of the present invention is determined such that the axis of the grinder 19 is inclined (see FIG. 4) at a position where the quill would be flexed in the conventional prior art machine.

In the drawings, reference numeral 33 denotes a cam follower which prevents the grinding head 15 from being raised during rotation, while numerals 34 and 35 denote proximal switches which detect the rotational position of the grinding head 15.

In summary, as has been described, in the internal grinding machine of the present invention, the grinding head to which the grinding shaft having the quill carrying the grinder is fixed is mounted in such a manner that it can pivot about a pivot point which is substantially on the center of the front edge of the grinding head. With this arrangement, it is posssible to obviate the problem in the conventional prior art grinding machines caused by the flexing of the quill, because of the grinding head of the present invention can pivot in such a manner as to absorb the influence of flexing of the quill. Since this pivotal operation is effected simultaneously with ordinary traversing grinding, it is possible to remarkably improve the precision (cylindricality and straightness) of the grinding of the work.

What is claimed is:

1. An internal grinding machine for grinding the inner surface of a workpiece comprising: a traverser table mounted on fixed bed means for sliding movement in a longitudinal direction, grinding head means for grinding said workpiece, said grinding head means being mounted on the traverser table in such a way as to provide preposition adjustment in a longitudinal direction, a grinder shaft spindle fixed to one surface of the grinding head and provided on the front end surface thereof with a grinder shaft carrying at its distal end a grinder, the traverser table being mounted for sliding movement so as to enable it to bring the grinding head to a predetermined position with respect to the workpiece, the grinding head being arranged in such a way that a rear end of the grinding head can swing to the left and right about a pivot point located at a front end and centrally thereof, the rear end of the grinding head being connected through a bifurcated connecting plate to an eccentric cam mechanism which is moved by movement from a hydraulic cylinder of said eccentric cam mechanism, said hydraulic cylinder actuating a hydraulic cylinder rod, whereby the internal grinding machine effects grinding of an inner surface of a workpiece with a high degree of cylindricality and straightness.

2. The internal grinding machine of claim 1 and further comprising a second hydraulic cylinder and a second cylinder rod for moving the traverser table in a longitudinal direction on a fixed bed.

3. The grinder table of claim 2 and further comprising proximal switches to detect the rotational position of said grinding head about said centrally located pivot point.

4. An internal grinding machine comprising: a traverser table mounted on a fixed bed for longitudinally sliding movement with respect thereto, a grinding head mounted on said table for free position adjustment in the longitudinal direction, a grinder shaft spindle fixed to the upper surface of said grinder head and provided on a front end surface thereof with a grinder shaft carrying at its distal end a grinder, said traverser table moving in sliding relationship with respect to said fixed bed so as to bring said grinder to a predetermined position with respect to a workpiece thereby enabling said grinder to grind the inner surface of said workpiece, said grinding head being mounted so that a rear end of said grinding head can swing to the left and right about a vertical axis pivot point located at a center of a front end of said grinding head, the rear end of said grinding head being connected to an eccentric cam mechanism comprising an eccentric cam shaft and an eccentric cam shaft bearing, said eccentric cam mechanism acting through an eccentric cam mechanism hydraulic cylinder and an eccentric cam mechanism cylindrical rod to thereby swing said grinding head in a predetermined angle in accordance with the amount of eccentricity of the eccentric cam mechanism.

5. The internal grinding machine of claim 4 and further comprising a clearance adjusting screw on said grinding head for adjusting an initial inclination angle of said grinder shaft spindle, and a cam follower connected to a bifurcated connecting plate, said bifurcated connecting plate providing multiple arms that slidably connect said cam shaft through an eccentric cam shaft bearing.

6. The internal grinding machine of claim 4, said eccentric cam mechanism further comprising a rotary plate for rotating said eccentric cam shaft through a predetermined angle.

7. The internal grinding machine of claim 6, said eccentric cam mechanism further comprising a rear stroke end stopper and a front stroke end stopper to limit the movement of said rotary plate of said cam mechanism.

8. The internal grinding machine of claim 1 and further comprising an eccentric cam provided within an arm portion at the end of a connecting plate, said connecting plate and a spindle being inclined horizontally and in parallel with said table.

9. The internal grinding machine of claim 8, said connecting arm portion further comprising adjusting screws by which an initial angle of inclination of the spindle is adjusted, rotation of said eccentric cam causing, through said adjusting screws, the connecting plate to incline.

* * * * *